United States Patent [19]

Moriya et al.

[11] Patent Number: 5,011,717

[45] Date of Patent: Apr. 30, 1991

[54] EXPLOSION PREVENTING PORCELAIN HOLLOW INSULATOR

[75] Inventors: Tsutomu Moriya, Chita; Yasunori Matsuura, Kasugai; Takao Nakamura, Iwakura, all of Japan

[73] Assignee: NGK Insulators, Ltd., Japan

[21] Appl. No.: 375,478

[22] Filed: Jul. 5, 1989

[30] Foreign Application Priority Data

Jul. 7, 1988 [JP] Japan ..... 63-170291

[51] Int. Cl.[5] ..... H01B 17/00

[52] U.S. Cl. ..... 428/34.4; 174/137 A; 174/137 B

[58] Field of Search ..... 174/137 A, 137 B; 428/34.4

[56] References Cited

U.S. PATENT DOCUMENTS

| | | | |
|---|---|---|---|
| 4,091,124 | 5/1978 | Reighter | 174/137 B |
| 4,177,322 | 12/1979 | Homan et al. | 174/137 A |
| 4,476,155 | 10/1984 | Niemi | 174/137 A |
| 4,749,824 | 6/1988 | Orbeck | 428/447 |

FOREIGN PATENT DOCUMENTS 61-151909 7/1986 Japan .

*Primary Examiner*—James J. Seidleck

*Attorney, Agent, or Firm*—Parkhurst, Wendel & Rossi

[57] ABSTRACT

A hollow porcelain insulator including an elastic insulating layer having a tensile strength of at least 150 kg/cm$^2$ and a thickness of at least 2 mm for improving an explosion preventing property.

3 Claims, 6 Drawing Sheets

(Conventional Hollow Insulator, Example 1)

(Conventional Hollow Insulator with Rubber Layer, Example 2)

(Present Invention)

EXPLOSION PREVENTING PORCELAIN HOLLOW INSULATOR

BACKGROUND OF THE INVENTION (1) Field of the Invention

The present invention relates to a porcelain hollow insulator for transformers, instrument transformers, switches or the like and particularly to improvement of an explosion preventing property of a porcelain hollow insulator for a gas or oil filled insulated bushing.

(2) Related Art Statement

Hitherto, there has been proposed a porcelain hollow insulator as disclosed in Japanese Patent Application Laid-open Publication No. 61-151909. Such a porcelain insulator has a resin lining layer formed on the inner wall surface by spraying a resin by means of a spray nozzle while the hollow insulator is rotated about a fixed longitudinal axis. The resin lining layer is useful to improve safety of the porcelain insulator by preventing the fragments of the insulator from scattering so as not to damage peripheral instruments and/or human bodies when the porcelain insulator is broken by an abnormal high internal pressure caused by an accidental flashover within the insulator or an external force due to an earthquake or the like.

Such conventional porcelain hollow insulators used in the bushings however have not been settled regarding numerical conditions of the adhering force, tensile strength and thickness of the resin layers. Accordingly, there is a problem that some of the porcelain hollow insulators having the resin lining layer do not have a satisfactory explosion preventing property.

SUMMARY OF THE INVENTION

It is an object of the present invention to provide a porcelain hollow insulator having an excellent explosion preventing property by setting the tensile strength and the thickness of the lining layer adhered to the inner wall surface of the insulator.

According to the present invention, the insulator has an elastic insulating layer adhered to the inner wall surface thereof which has a tensile strength of at least 150 kg/cm$^2$ at room temperature and a thickness of at least 2 mm.

The elastic insulating layer having such a tensile strength and thickness is adhered to the inner wall surface by means of an adhesive having a high adhesion and treated by a primer, if necessary, to increase the adhesion of the elastic insulating layer. Accordingly, a kinetic energy of the fragments scattered by the internal pressure is reduced when the insulator is broken.

Further advantages of the present invention will become apparent as the following description of an embodiment proceeds with reference to the drawings.

DETAILED DESCRIPTION OF THE PRESENT INVENTION

Figure 3:
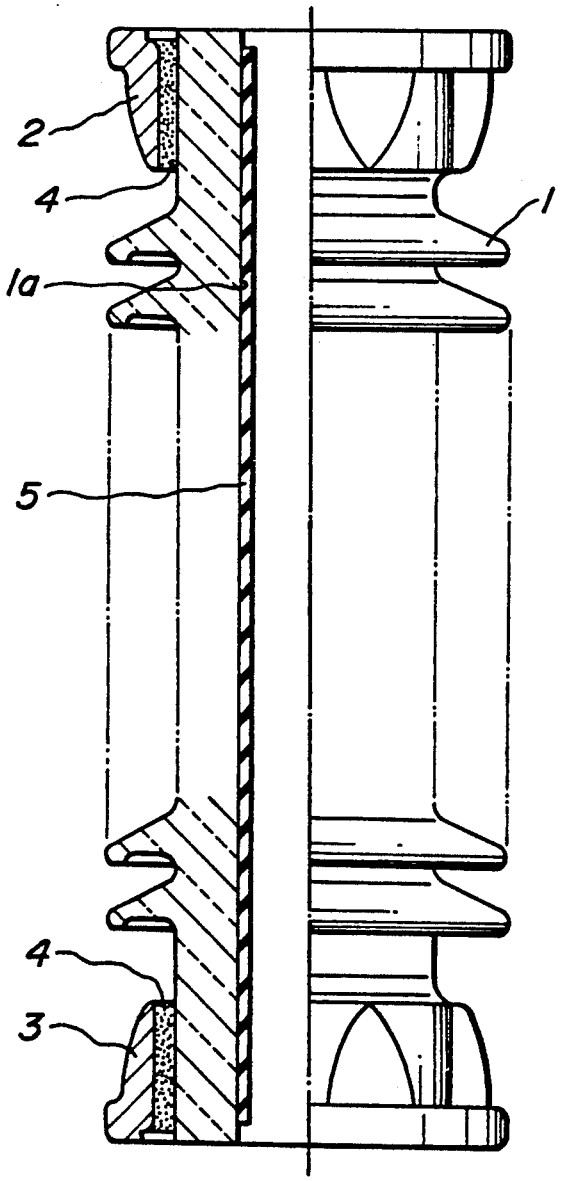
FIG. 3 is an elevational view of the insulator shown in partly longitudinal section.

Referring to FIG. 3 illustrating a porcelain hollow insulator, the insulator 1 is provided with metal flange members 2 and 3 adhered to the peripheral surface of the top and bottom portions by means of cement 4, respectively. The tubular insulator is also provided with an elastic insulating layer 5 of an urethane rubber adhered to the inside surface 1*a*. The urethane rubber layer 5 may be formed on the inside surface 1*a* of the hollow insulator 1 by molding or spraying a solution of urethane rubber after an urethane adhesive or the like is applied to the inside surface 1*a* of the insulator 1.

In this example, the urethane rubber layer 5 has a tensile strength of 150 kg/cm$^2$ at the room temperature and a thickness of 2 mm.

Figure 4:
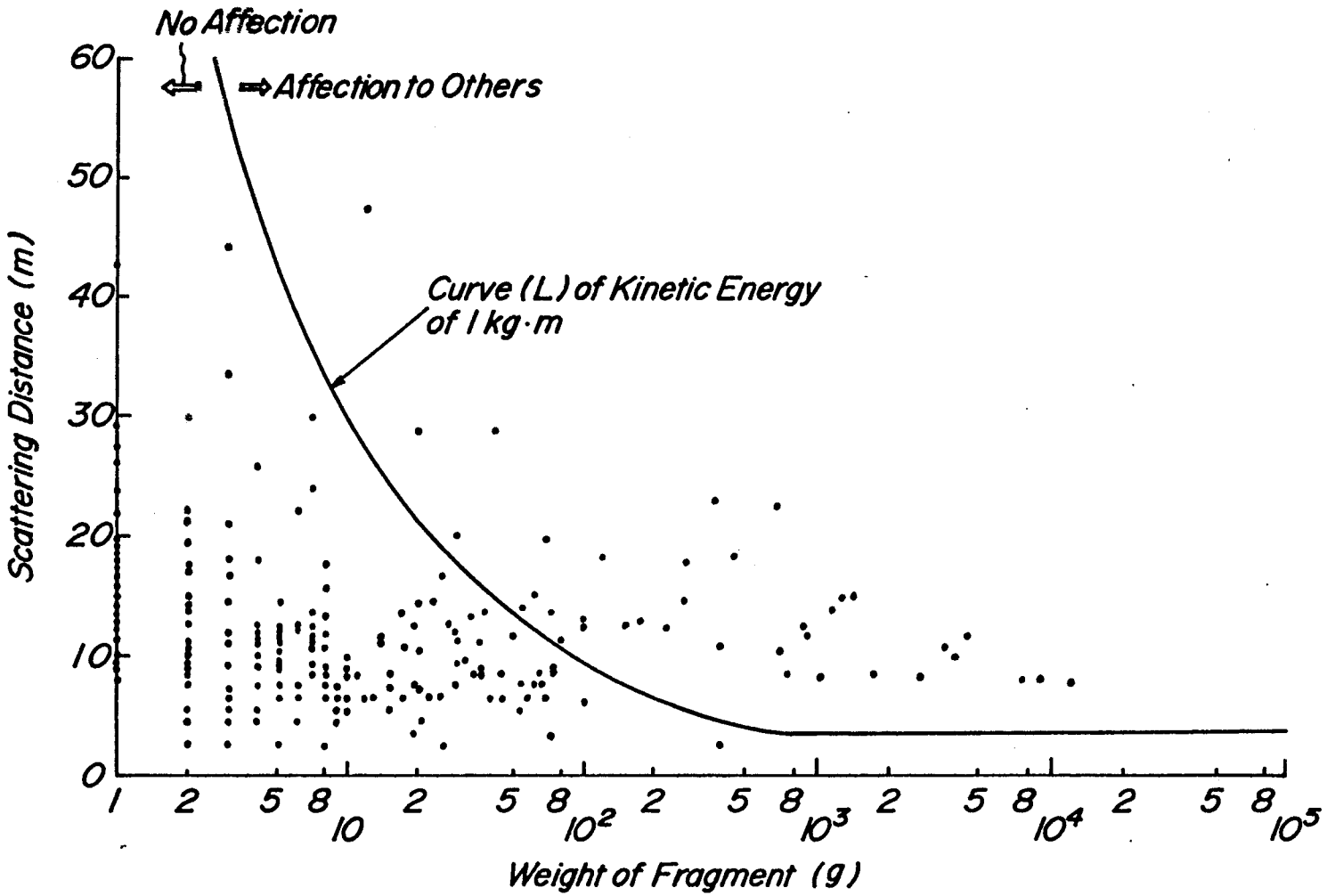
FIG. 4 is a graph showing results of breaking tests of a conventional hollow insulator (Example 1)
Figure 5:
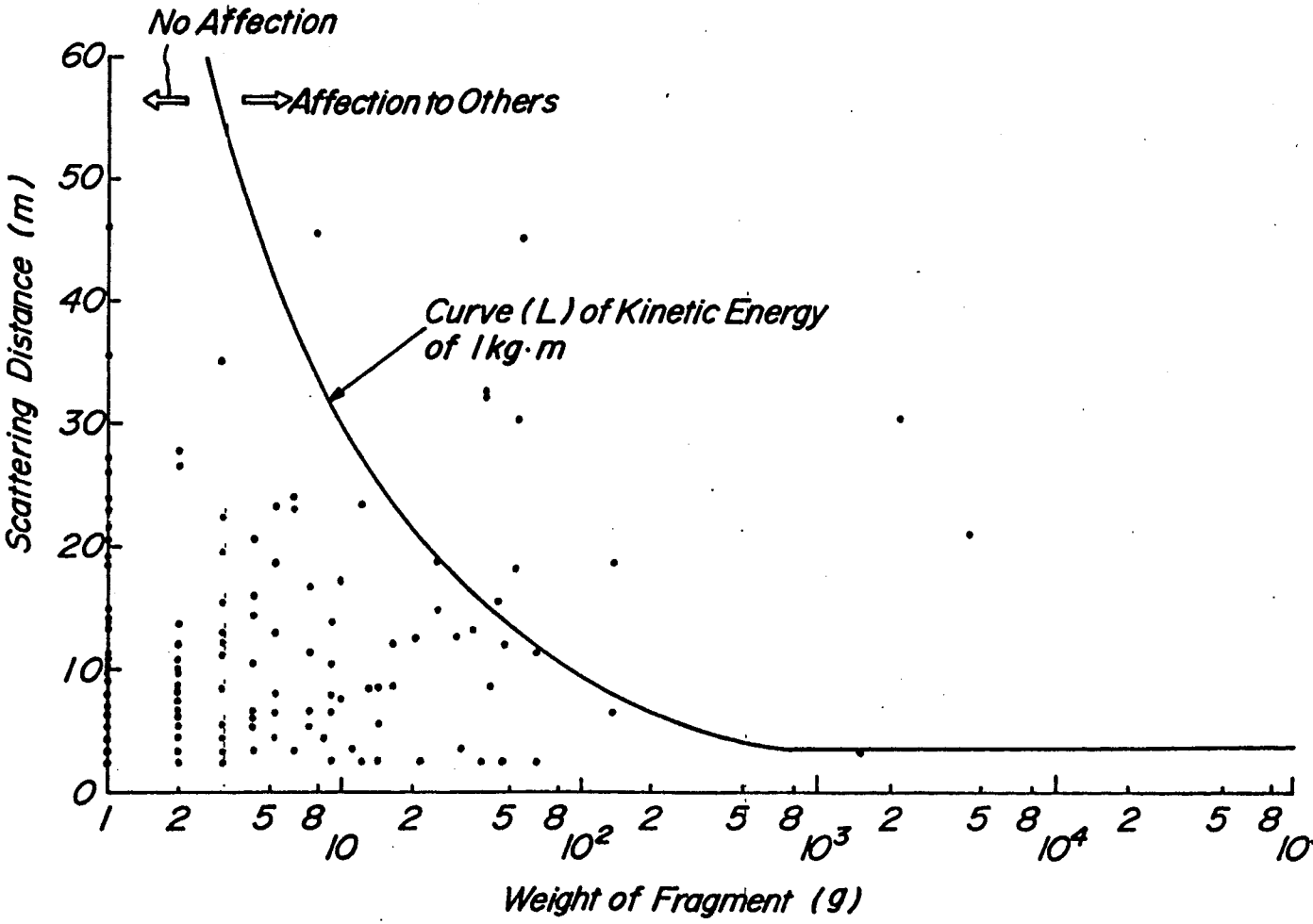
FIG. 5 is a graph showing results of breaking tests of a conventional hollow insulator with a rubber layer (Example 2)
Figure 6:
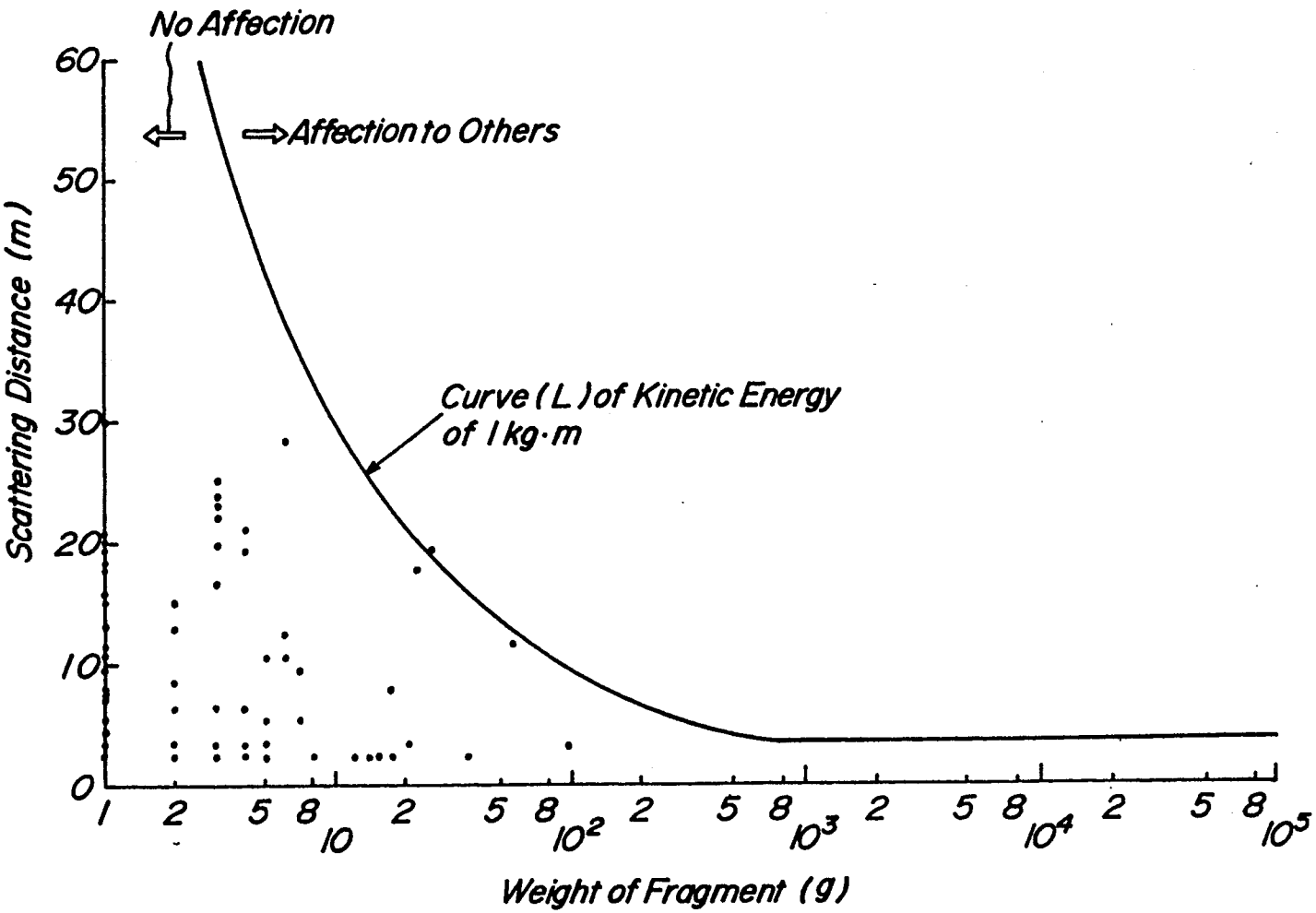
FIG. 6 is a graph showing results of breaking tests according to the present invention.

Referring to graphs in FIGS. 4~6 showing the weight of fragments of insulator in the axis of abscissa and the scattering distance of fragments in the axis of ordinate, there are shown results of explosion tests of examples 1, 2 and the present invention carried under a condition in which insulating gas is filled at a pressure of 5 kg/cm$^2$·G. The insulators were broken by applying a hot and cold thermal shock, for example, heating a portion of the insulator by a conventional heater and subsequently cooling with water. In each of the Figures, the curve (L) indicates the kinetic energy of insulator fragments of 1 kg·m. The fragments of kinetic energy lower than the curve (L) do not affect the peripheral instruments, but the fragments of kinetic energy higher than the curve (L) give rise to troubles upon hitting them. The graph in FIG. 4 shows results in explosion tests of the conventional hollow insulator, (Example 1).

As will be seen from the graph in FIG. 4, there are many insulator fragments of kinetic energy higher than the curve (L). The total kinetic energy of the fragments higher than the curve (L) (hereafter called the total kinetic energy of fragments) is as large as 640 kg·m.

The graph in FIG. 5 shows a result from an explosion test of the conventional hollow insulator provided with a butyl ruber layer having a tensile strength of 75 kg/cm$^2$ and a thickness of 2 mm (Example 2). According to this insulator, the number of fragments having kinetic energy higher than the curve (L) is less than the conventional one, but this insulator is not yet safe. This cause is considered that the tensile strength of the rubber layer is insufficient.

Figure 1:
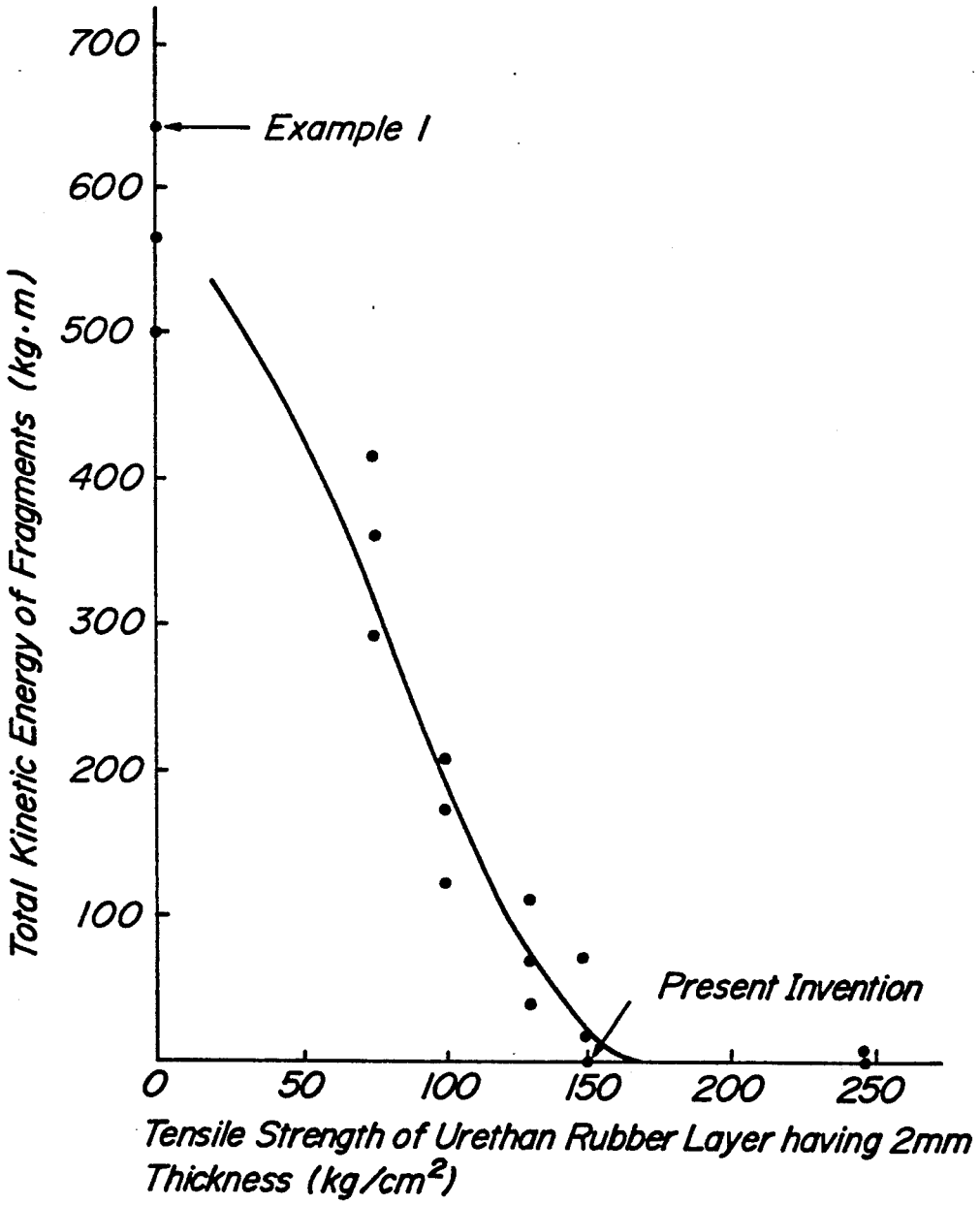
FIG. 1 is a graph showing relations between the tensile strength of urethane rubber layers and the total kinetic energy of fragments of porcelain hollow insulators.

The graph in FIG. 6 shows an embodiment of the present invention, which is provided with a urethane rubber layer having a tensile strength of 150 kg/cm$^2$ and a thickness of 2 mm. It is confirmed from the result shown in FIG. 6 that the insulator according to the present invention is very safe since there is no fragment of insulator having a kinetic energy higher than the curve (L). The total kinetic energy of fragments was measured by tests in which the tensile strength of an urethane rubber layer 5 was stepwisely varied at room temperature. The results of the tests are shown in FIG. 1. It will be seen from FIG. 1, the total kinetic energy of the fragments is large at a tensile strength in a range of 70~140 kg/cm$^2$, but becomes substantially zero at a tensile strength of at least 150 kg/cm$^2$. Accordingly, the tensile strength of the urethane rubber layer must be at least 150 kg/cm$^2$.

Figure 2:
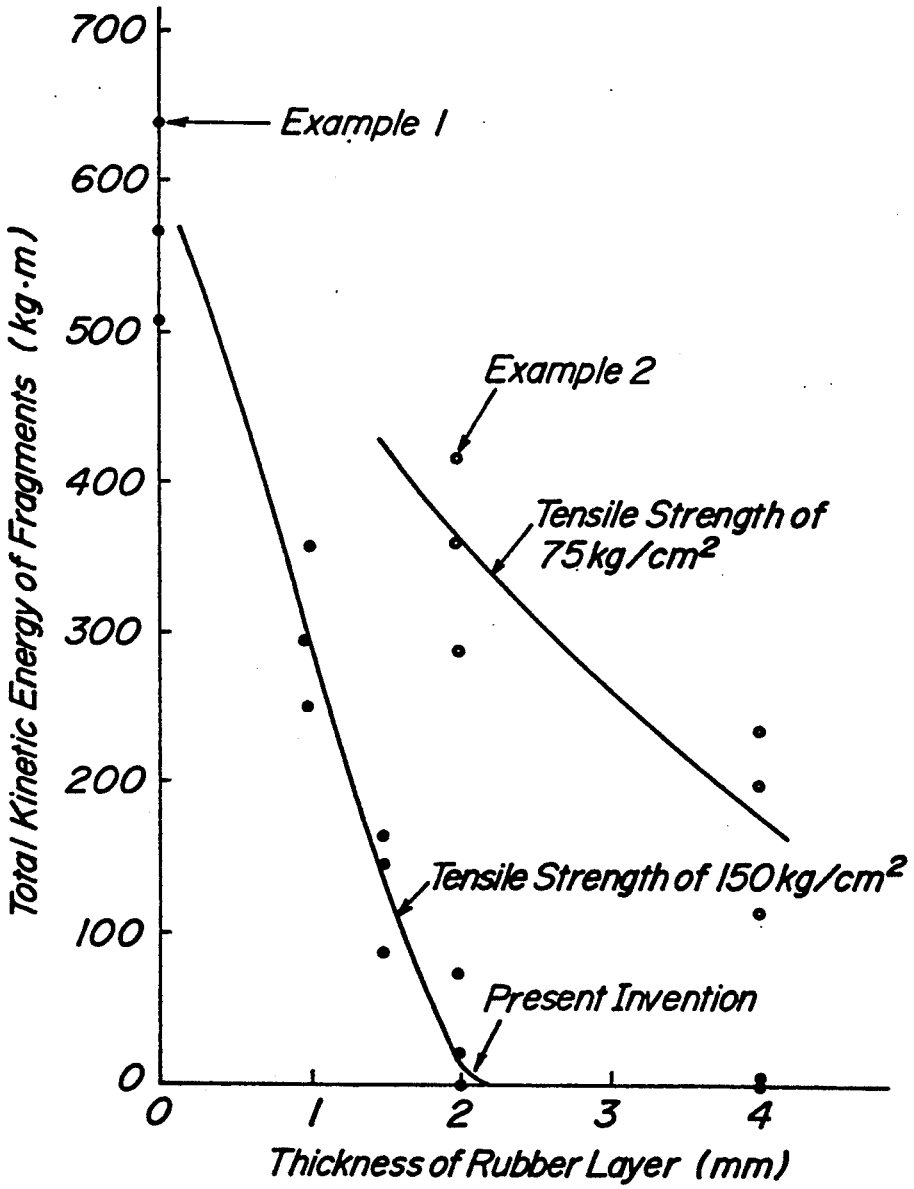
FIG. 2 is a graph showing relations between the thickness of the rubber layers and the total kinetic energy of fragments of the insulators.

The total kinetic energy of fragments was also measured by tests in which the thickness of urethane rubber layer 5 was stepwisely varied. The results of the tests are shown in FIG. 2. As will be seen from FIG. 2, the total kinetic energy of the fragments is abruptly reduced in a range of 1 mm~2 mm thickness and becomes substantially zero at a thickness larger than 2 mm. Accordingly, the thickness of the urethane rubber layer 5 must be at least 2 mm. Furthermore, the total kinetic energy of fragments was measured by tests in which the thickness of an urethane rubber layer having a tensile strength of 75 kg/cm$^2$ was varied. These results are also shown by a curve of Example 2 in FIG. 2. The total kinetic energy is higher than 100 kg·m as shown in FIG. 2. Any satisfactory results can not be obtained by the insulator of Example 2.

As will be understood from the tests mentioned above, a porcelain hollow insulator having an excellent explosion preventing property such that the total kinetic energy of fragments is very small is obtained by providing an elastic insulating layer 5 of urethane rubber being firmly adhered to the inner wall surface of the insulator and having a tensile strength of at least 150 kg/cm$^2$ and a thickness of at least 2 mm.

According to the present invention, the elastic insulating layer may be formed of not only urethane rubber but also natural rubber, silicon rubber, butyl rubber, ionomer resin, polypropylene, polyethylene, ethylene-vinyl acetate co-polymer, styrene-butadiene resin.

The tensile strength of the elastic insulating layer 5 may be 500 kg/cm$^2$ in maximum and the thickness of the elastic insulating layer 5 may be 10~20 mm in consideration of matching with other instruments, dimensional allowance and cost.

What is claimed is:

1. A hollow porcelain insulator comprising an elastic insulating layer adhered to the inner wall surface thereof, said elastic insulating layer having a tensile strength of at least 150 kg/cm$^2$ at room temperature and a thickness of at least 2 mm.

2. The porcelain insulator of claim 1, wherein said elastic insulating layer is a rubber selected from the group consisting of urethane rubber, natural rubber, silicon rubber and butyl rubber.

3. The porcelain insulator of claim 1, wherein said elastic insulating layer is a resin selected from the group consisting of ionomer resin, polypropylene, polyethylene, ethylene-vinyl acetate co-polymer and styrene-butadiene resin.

* * * * *